US006967631B1

(12) United States Patent
Park et al.

(10) Patent No.: US 6,967,631 B1
(45) Date of Patent: Nov. 22, 2005

(54) MULTIPLE MEANDER STRIP MONOPOLE ANTENNA WITH BROADBAND CHARACTERISTIC

(76) Inventors: Ikmo Park, 203-1004, Hyundai Apt., Sanghyeon-dong, Yongin-si, Gyeonggi-do, 449-525 (KR); Yun Ho Lee, 188-23, Hyojadongl-ga, Wansan-gu, Jeonju-si, Jeollabuk-do, 560-852 (KR)

( * ) Notice: Subject to any disclaimer, the term of this patent is extended or adjusted under 35 U.S.C. 154(b) by 0 days.

(21) Appl. No.: 10/970,732

(22) Filed: Oct. 22, 2004

(30) Foreign Application Priority Data

May 10, 2004 (KR) ..... 10-2004-0032722

(51) Int. Cl.[7] ..... H01Q 1/36
(52) U.S. Cl. ..... 343/895; 343/702
(58) Field of Search ..... 343/895, 702, 343/853, 700 MS, 850, 852; H01Q 1/36

(56) References Cited

U.S. PATENT DOCUMENTS 2,630,530 A * 3/1953 Adcock et al. ..... 343/848
6,115,005 A * 9/2000 Goldstein et al. ..... 343/895
6,337,670 B1 * 1/2002 Chen ..... 343/895
6,664,938 B2 * 12/2003 Strickland ..... 343/895

* cited by examiner

*Primary Examiner*—Hoanganh Le
(74) *Attorney, Agent, or Firm*—Nixon Peabody LLP

(57) ABSTRACT

Disclosed is a multiple meander strip monopole antenna, which can have a broad bandwidth and easily miniaturize the antenna by using a meander structure. A grounding conductor plate is coupled to the under face of a dielectric base plate. A radial cross-strip is disposed symmetrically at the center of the upper surface of the dielectric base plate. Each radiating member of a multiple radiator is connected to the end portion of each corresponding branch of the radial cross-strip and stands substantially perpendicular to the base plate. Each radiating member is composed of a vertical strip section having a tapered structure, in which its width is progressively widened upwardly for an impedance matching and at least one meander strip section connected integrally to the upper end of the vertical strip section. When a feeding is carried out at the center of the radial cross-strip, a signal radiated from the multiple radiator is cancelled out in the axial direction of θ=0° and a radiation gain is increased as θ increases, thereby providing a conical beam radiation pattern. A broad bandwidth from 2.9 GHz to 10.85 GHz can be achieved and an excellent monopole radiation pattern having the same gain in all directions can also be achieved.

9 Claims, 10 Drawing Sheets

MULTIPLE MEANDER STRIP MONOPOLE ANTENNA WITH BROADBAND CHARACTERISTIC

BACKGROUND OF THE INVENTION

1. Field of the Invention

The present invention relates to an antenna, more particularly to a folded multi-strip monopole antenna, in which it can be miniaturized by reducing the height thereof.

2. Description of the Related Art

Recently, researches have been extensively made in order to develop a technology related to an ultra wideband (UWB) communication. The UWB communication is regarded as a core technology in the next generation wireless communication. The UWB communication does not use a carrier wave, which is used to transmit a base band signal in a general wireless communication system. Instead, it uses a low power pulse having a signal time slot of only one nanosecond to a few picoseconds. It transmits a low power signal over a broad frequency band, so that the power consumption is less than the conventional systems. It shares the frequency band used by the conventional narrowband systems, without any separate allocation of an available frequency band, so that limited frequency resources can be used efficiently. Moreover, the UWB communication is capable of very delicately tracking an object, and thus is applicable to imaging systems such as a radar or a ground penetration radar system (GPRS). It can realize a data transmission rate of more than ten times that of a general wireless local area network (LAN).

Since a broad frequency band from 3.1 GHz to 10.6 GHz is used in this UWB communication technology, a wideband antenna, which can transmit and receive a signal in a broad range of frequency, is necessarily required. In addition, according to the miniaturization of communication equipments due to the advanced technology, a small antenna is strongly required. There is, therefore, a need to develop an antenna, which can meet a wideband characteristic suitable for the UWB communication technology and can also be miniaturized.

Antennas having a wideband characteristic meeting the UWB bandwidth are exemplified by a biconical antenna, a horn antenna, a reflector antenna, a spiral antenna, and a log periodic antenna, etc. However, a biconical antenna, a horn antenna, and a reflector antenna are relatively large in their size, so that they can hardly satisfy the requirements for small antennas. A spiral antenna and a log periodic antenna cause a dispersion due to the radiation time difference between a low and high frequency with respect to an impulse signal composed of wideband frequency signals, not a narrow band sinusoidal wave, and thus it leads to a distortion in the transmitted and received signal.

SUMMARY OF THE INVENTION

It is an object of the present invention to provide a multiple meander strip monopole antenna, which has a wideband characteristic meeting the UWB communication bandwidth, and can be miniaturized.

According to one aspect of the invention in order to accomplish the object, there is provided a multiple meander strip monopole antenna. The antenna of the invention includes: a) a dielectric base plate; b) a radial cross-strip, having a plurality of branches of equal length which extend into a radial direction with equiangular intervals therebetween, disposed on the upper surface of the dielectric base;

and c) a multiple radiator including the same number of radiating members as that of the branches of the radial cross-strip, each radiating member being composed of a vertical strip section formed of a flat conductor strip and a meander strip section connected integrally to the upper end of the vertical strip section, the meander strip section constituting a '⊐'-shaped conductor strip, wherein each radiating member is connected to the end portion of each corresponding branch of the radial cross-strip and stands substantially perpendicular to the base plate, by the vertical strip section. This antenna is one type of a multiple meander strip monopole antenna.

The above-described antenna, in particular, the meander strip section is preferred to include a multi-stepped strip section, in which at least one conductor strip having a '⌐' shape is connected, in a meander fashion, to the end of the '⊐'-shaped conductor strip. This antenna structure can be called a typical multiple meander strip monopole antenna structure in that it is a multiple-meandered structure in which a '⌐'-shaped strip is connected repeatedly one above the other. It has a characteristic that the bandwidth increases as the number of meandering increases. This antenna structure can be used for designing an antenna having a wideband characteristic from 2.9 GHz to 10.82 GHz, which meets the UWB communication band from 3.1 GHz to 10.6 GHz. The excellent omni-directional radiation pattern of this antenna is suitable for a wireless LAN or a wireless personal area network (WPAN), or the like, which requires the omni-directional communication.

Furthermore, each radiating member of the multiple radiator is preferred to have a same structure and to be disposed symmetrically about the center of the radial cross-strip on the upper surface of the base plate. Therefore, when a feeding point is positioned at the center of the radial cross-strip, current components flowing that portion of the meander strip section parallel to the base plate are cancelled out so that a signal radiated from the multiple radiator is cancelled out in the axial direction of $\theta=0°$ and a radiation gain increases as $\theta$ increases, thereby providing a conical beam radiation pattern.

It is preferable that the radial cross-strip includes X branch-strips each having a same line-width and length and being disposed in equiangular intervals of 360°/X. Preferably, the vertical strip section has a tapered structure, in which its width is progressively widened upwardly for an impedance matching. The tapered structure of the vertical strip section alleviates the impedance variation with the frequency, so that it contributes to obtain the wideband characteristic. In addition, in order to minimize a return loss through an impedance matching in the above antenna structure, it is preferable that the total length of the vertical strip section and the meander strip section is $\lambda_0/4$, where $\lambda_0$ is wavelength corresponding to a desired matching frequency. It is also preferable that a ratio of the height of the multiple radiator to the $\lambda_0/4$ length of a starting frequency is less than 60%. This is, the lower height is more advantageous for the miniaturization of antenna.

In addition, the antenna of the invention may further includes a grounding conductor plate coupled to the under face of the base plate in order to provide the integration thereof. Also, the base plate and the grounding conductor plate have preferably a circular shape. The circular grounding conductor plate is advantageous in that a current flow in the grounding conductor plate can be uniform in all directions, thereby reducing the cross polarization and strengthening the characteristic of the omni-directional radiation pattern.

A further understanding of other features, aspects, and advantages of the invention will be realized by reference to the following description, the appended claims, and the accompanying drawings.

BRIEF DESCRIPTION OF THE DRAWINGS

Preferred embodiment(s) of the invention will be described with reference to the accompanying drawings, in which.

DETAILED DESCRIPTION OF THE PREFERRED EMBODIMENTS

The preferred embodiments of the invention will be hereafter described in detail with reference to the accompanying drawings.

Figure 1A:
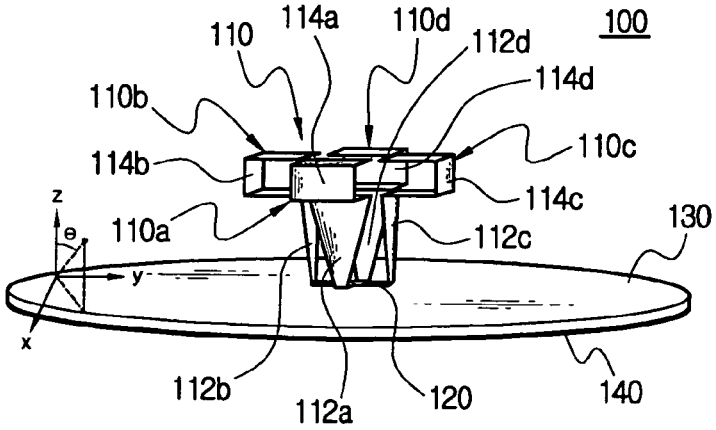
FIGS. 1*a*, 1*b* and 1*c* are respectively a perspective view, a plan view and an elevational view showing a basic structure of a multiple meander strip monopole antenna according to a first embodiment of the invention.
Figure 1B:
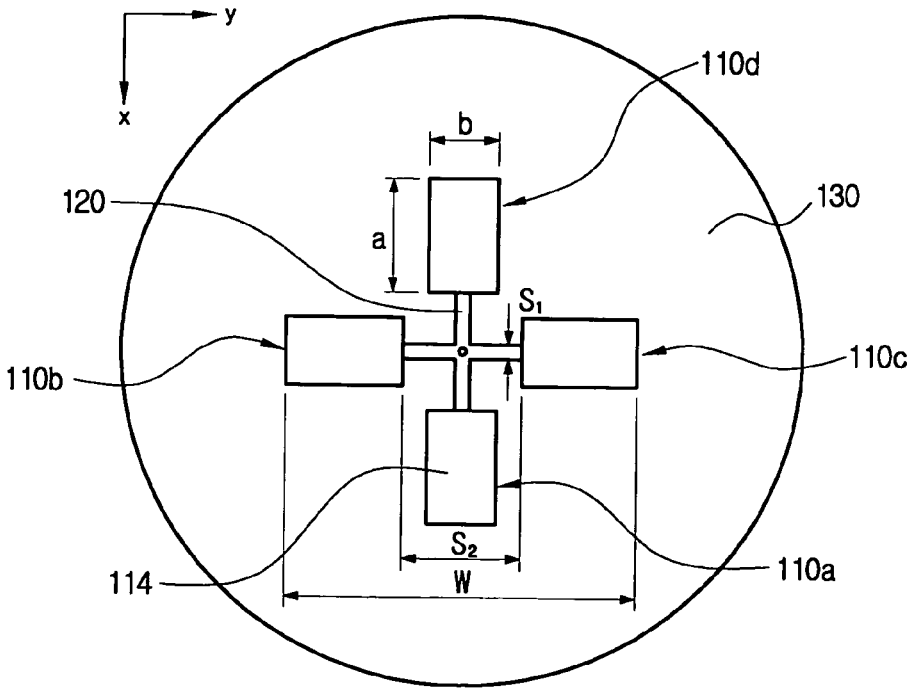
Figure 1C:
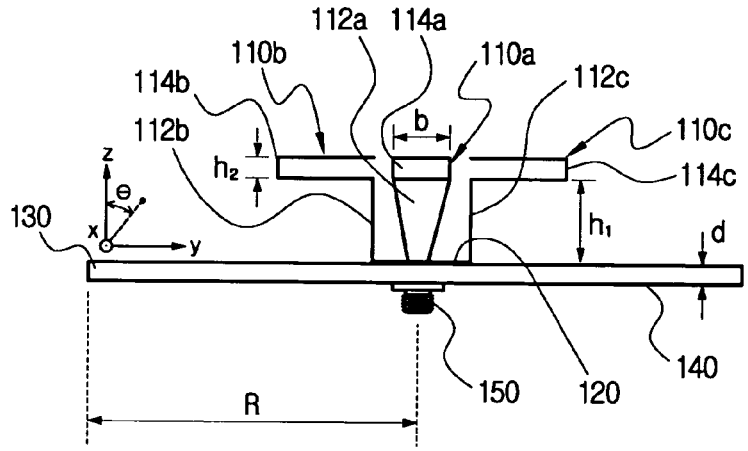

FIGS. 1*a*, 1*b* and 1*c* are respectively a perspective view, a plan view and an elevational view showing a basic structure of a multiple meander strip monopole antenna according to the first embodiment of the invention, in which the antenna of the invention is denoted by a reference numeral 100. Referring to FIGS. 1*a*, 1*b* and 1*c*, the structure and operational principle of the antenna according to the first embodiment are described. The antenna 100 of the invention has a folded multi-strip monopole antenna structure, in which an end portion of a vertical strip is bent into a'⊐'-shape and, therefore, an overall antenna height can be reduced. In addition, an inductance component dominant in a narrowband monopole antenna can be compensated by a capacitance component built up between parallel strips so that the bandwidth can be significantly improved.

Specifically, the antenna 100 has a multiple radiator 110, a cross-strip 120 and a dielectric base plate 130. The multiple radiator 110 is composed of four radiating members 110*a*, 110*b*, 110*c*, and 110*d* made of a conducting strip. The cross-strip 120 is made of a conductor strip so as to form a crucifomm. Generally, an antenna needs a ground plane, which can employ an external ground plane, depending on an installation condition. However, the present invention may include this ground plane as an element of the invention. The antenna shown in the figures includes an antenna plane, which is constructed by adding a grounding conductor plate 140 at the bottom face of the dielectric base plate 130. The cross-strip 120 is disposed approximately at the center of the upper surface of the dielectric base plate 130. A feeding point (or a feeder terminal) 150 of a feeder signal provided through a coaxial cable is placed so as to face the center of the cruciform cross-strip 120 through the grounding conductor plate 140. The four radiating members 110*a*, 110*b*, 110*c* and 110*d* have the same size and structure, and are connected to the end portion respectively of the four branches of the cruciform cross-strip 120, so that they are made to be disposed symmetrically on the antenna plane. Each radiating member 110*a*, 110*b*, 110*c*, 110*d* is erected vertically on the dielectric base plate 130, and composed of a vertical strip section 112*a*, 112*b*, 112*c*, 112*d* and a meander strip section 114*a*, 114*b*, 114*c*, 114*d*, which is bent into a '⊐'-shape and connected integrally to the upper end of the vertical strip section 1112*a*, 112*b*, 112*c*, 112*d*. The vertical strip section 112*a*, 112*b*, 112*c*, 112*d* has a height of $h_1$, and has a tapered structure with its width reduced progressively downwards of the dielectric base plate 130 so that the meander strip section 114*a*, 114*b*, 114*c*, 114*d* can be connected to the cross-strip 120 having a different width. All the horizontal sections of the meander strip section 114*a*, 114*b*, 114*c*, 114*d* have an identical size of a×b.

The feeder terminal 150 located at the under face of the base plate 130 is connected to the meander strip section 114*a*, 114*b*, 114*c*, 114*d* via the vertical strip section 112*a*, 112*b*, 112*c*, 112*d*. The tapered structure alleviates an impedance variation according to a frequency variation, and thus contributes to obtain a wideband characteristic. That is, the impedance variation with a frequency is reduced by connecting, in series, the tapered vertical strip section 112*a*, 112*b*, 112*c*, 112*d* and the meander strip section 114*a*, 114*b*, 114*c*, 114*d* having a folded form, so that the resultant folded multi-strip monopole antenna can obtain a wideband characteristic.

The total length of the vertical strip section 112*a*, 112*b*, 112*c*, 112*d* and the meander strip section 114*a*, 114*b*, 114*c*, 114*d* is preferred to be approximately $\lambda_0/4$, where $\lambda_0/4$ is wavelength corresponding to the matching frequency. The four radiating members 110*a*, 110*b*, 110*c*, and 110*d* are disposed symmetrically, so that a signal is applied to each radiating member in the same phase. Therefore, two currents flowing along horizontal members of the meander strip sections 114*a* and 114*d* of a pair of the two radiating members 110*a* and 110*d* facing each other have a 180° opposite-phase to each other. Here, the above two currents can be described as currents flowing on the horizontal plane of θ=90° in the meander strip section 114*a* and 114*d*, that is, a portion parallel with the dielectric base plate 130. Consequently, radiated signals are canceled out along the direction of θ=0°, and the radiation by the vertical parts of the two radiating members 110*a* and 110*d* becomes dominant. The same result is obtained for the other pair of the two radiating members 110*b* and 110*c* facing each other. According to these features, the antenna 100 of the invention has an omni-directional conical beam radiation pattern.

The grounding conductor plate 140 is preferred to be a circular shape since in a monopole antenna, for example, a rectangular grounding conductor plate increases a cross-polarization, which leads to a different radiation gain for each horizontal cross-sectional pattern. Therefore, the circular-shape grounding conductor plate can achieve a uniform current flow in all directions thereof, so that the cross-polarization is reduced and the omni-directional radiation pattern characteristic is improved.

Since an inductance component is dominant in a general monopole antenna, a wideband characteristic of the monopole antenna can be achieved by compensating the insufficient capacitance component. The bandwidth of a cylindrical monopole antenna can be increased by an increase in a capacitance component, i.e., by increasing the radius of the cylinder, or attaching a patch or the like to the end of the monopole antenna. Nevertheless, there is a limitation in reducing the overall height. With the antenna 100 of the invention, however, a capacitance component built up at each '⊐'-shaped meander strip section 114*a*, 114*b*, 114*c*, 114*d* provides a wideband characteristic. In addition, the entire height of the antenna can be significantly reduced, so that a limitation in the space required for an antenna installation can be advantageously alleviated.

Figure 2A:
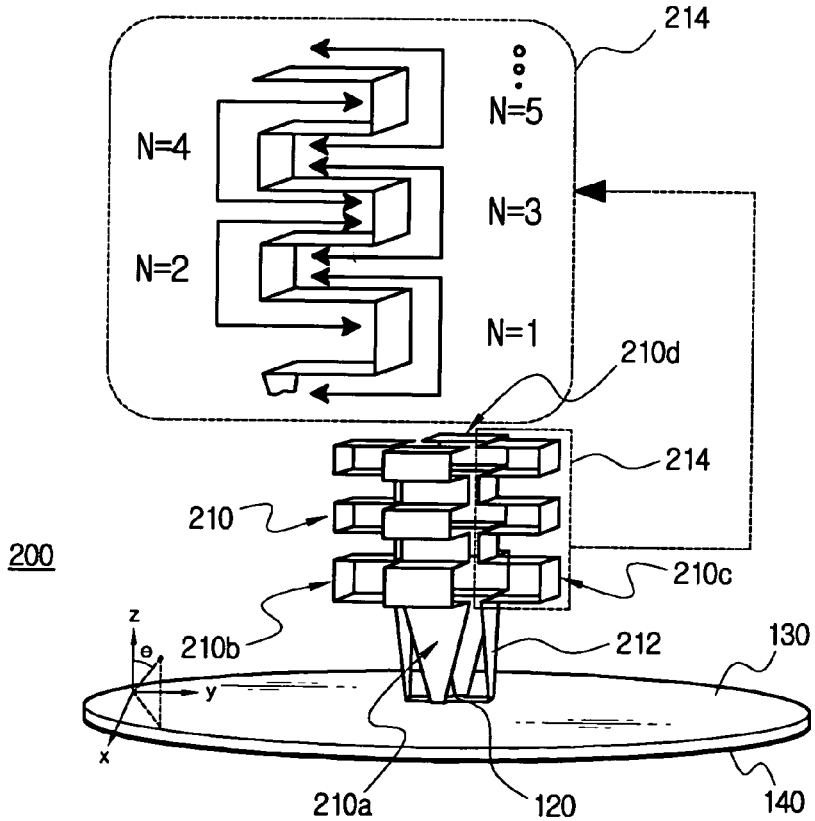
FIG. 2*a* is a perspective view showing a basic structure of a multiple meander strip monopole antenna according to a second embodiment of the invention.
Figure 2B:
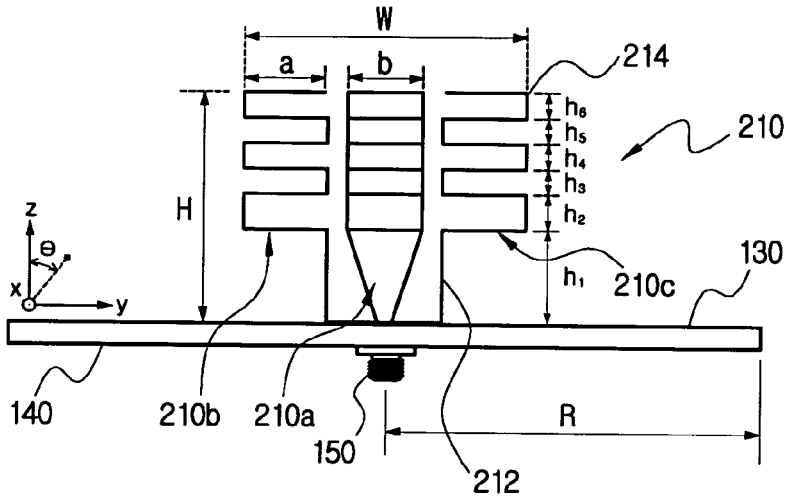
FIG. 2*b* is an elevational view showing a multiple meander strip monopole antenna with N=5, where N is the number of meandering turns.

FIG. 2*a* is a perspective view showing a basic structure of a multiple meander strip monopole antenna according to a second embodiment of the invention where the antenna of the second embodiment is denoted by a reference numeral 200. FIG. 2*b* is an elevational view showing a multiple meander strip monopole antenna with N=5, where N is the number of meandering turns. Referring to FIGS. 2*a* and 2*b*, the structure and operational principle of the antenna 200 according to the second embodiment are described below.

The structure of the antenna 200 is based on the folded multi-strip monopole antenna according to the above first embodiment. That is, the antenna 200 of this embodiment has a multiple meander strip monopole antenna structure, in which at least one step of a '⊓'-shaped strip is provided above the meandering strip section 114*a*, 114*b*, 114*c*, 114*d* in a meandering form. Therefore, a broader bandwidth can be achieved by this structure. In the figures, N denotes the number of meandering turns. N is one for the antenna 100 of the first embodiment, and is increased by one for each additional connection of the '⊓'-shaped strip. In FIGS. 2*a* and 2*b*, N is 5. Hereinafter, an antenna, which is meandered N times, is represented by N.

Figure 3A:
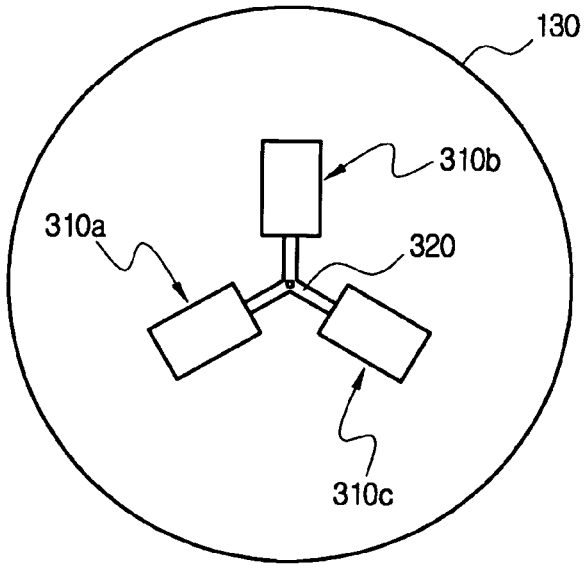
FIGS. 3*a*, 3*b* and 3*c* are plan views showing various antenna structures modified according to the invention.
Figure 3B:
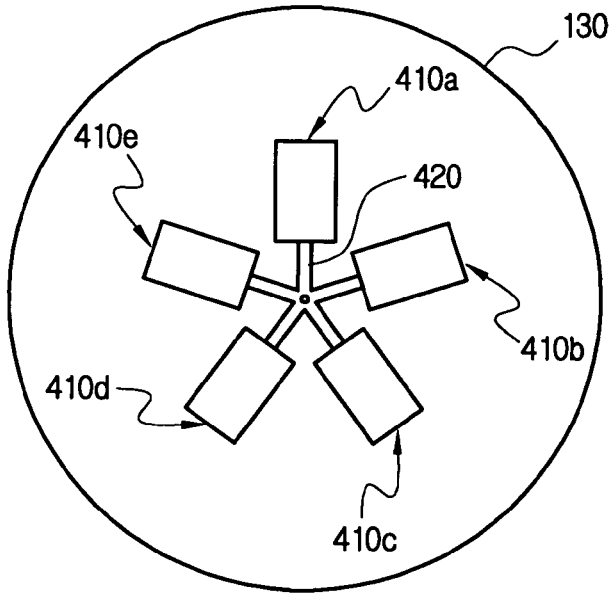
Figure 3C:
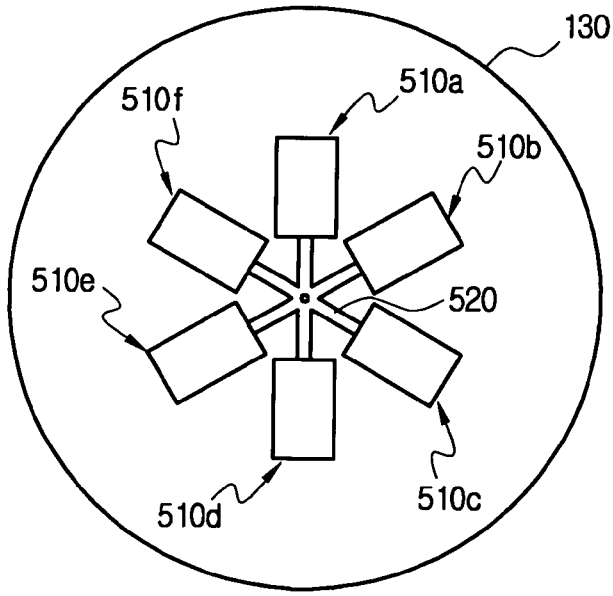

As described above, a typical structure of the antenna of the invention has a cruciform cross-strip having four branch-strips disposed in equiangular intervals of 90°, but may have a different structure of the cross-strip. FIGS. 3*a*, 3*b* and 3*c* are plan views showing various antenna structures modified according to the invention. The antenna structure of FIG. 3*a* has an Y-shaped cross-strip 320 having three branch strips disposed in equiangular intervals of 120°, and the antenna of FIGS. 3*b* and 3*c* have a radial cross-strip having five branch strips or six branch strips disposed in equiangular intervals respectively of 72° or 60°. When the cross-strip is modified into a different form other than a cruciform, for example, into a Y-shaped cross-strip 320, a five-branch strip 420, or 6-branch cross-strip 520, the number of the radiating member of the antenna structure is required to be changed so as to correspond to the branch number of the modified cross-strip. In generalization, if a radial cross-strip includes X branch strips, then these branch strips are disposed in equiangular intervals of 360°/X, and also the number of the radiating members becomes X. With this modification of the structure, however, in order to cancel out the radiated signals in the axial direction of θ=0°, the branches of the cross-strip is required be spaced apart from each other by an equiangular distance, and also to have the same line-width and length. In addition, each radiating member 310*a*~310*c*, 410*a*~410*e*, or 510*a*~510*f* is also needed to have the same structure and size. According to the invention, the meandering number of radiating members N is at least one.

The inventors have designed an actual antenna according to the embodiments of the invention, and measured its characteristics. The length $h_1$ of the tapered vertical strip section is $h_1$=8 mm. The length a of and the gap $h_2$ between an upper and lower parallel strip of the meander strip section are a=4.5 mm and $h_2$=1.5 mm. When the radius R of the circular grounding conductor plate is R=30 mm, the measured bandwidth ratio (BWR) was 1.85:1 in a range of 4.55 GHz to 8.4 GHz. Here, the dimension of the radiating member except for the grounding conductor plate is 15(W)×15(W)×9.5(H) $mm^3$. RT Duroid 5880 substrate of a relative dielectric constant $\epsilon_r$=2.2 was used as the grounding conductor plate, and the substrate thickness d was d=1.6 mm.

The design parameters, actually applied, are summarized in Table 1.

TABLE 1

| Antenna design parameters (Unit: mm) | | |
|---|---|---|
| Length of horizontal strip section | a | 4.5 |
| | b | 4.5 |
| Height of radiating member | $h_1$ | 8 |
| | $h_2$ | 1.5 |
| Thickness of base plate | d | 1.6 |
| Size of cruciform-strip | $S_1$ | 1 |
| | $S_2$ | 6 |
| Radius of circular grounding conductor plate | R | 30 |

The antenna of the second embodiment was constructed by repeatedly connecting a '⊓'-shaped strip one above another, and had the same height ($h_2$=1.5 mm) and the same length (a=4.5 mm) as in that of the first embodiment. For the antenna of the second embodiment, the variation of a return loss with N was examined. The calculated return losses for N=1, 2, and 3 are shown in FIG. 4.

Figure 4:
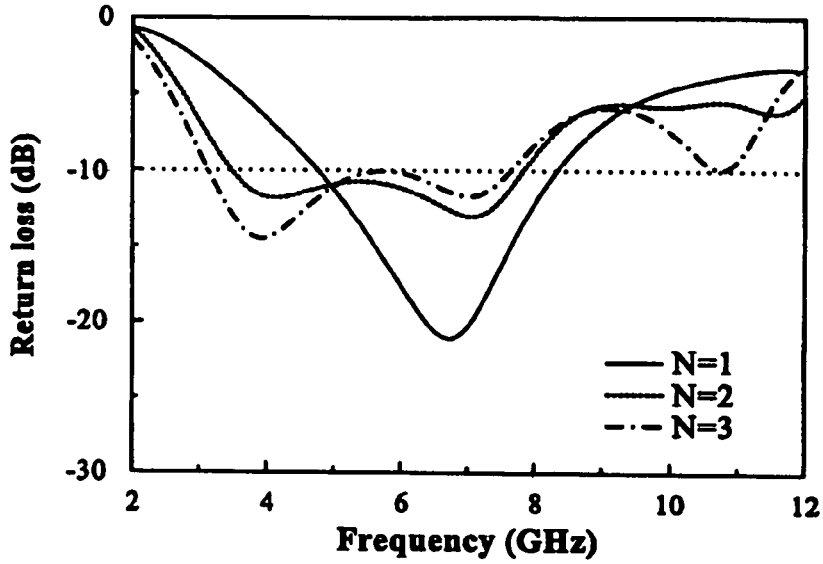
FIG. 4 is graphs showing calculated return losses of a multiple meander strip antenna according to a modified embodiment of the invention for N=1, 2 and 3, where N is a number of meander turns.

As shown in FIG. 4, it has been found that the increase of N leads to an increase in the overall length of the radiating element, so that the resonance length of the antenna is increased, and thus a matching frequency is progressively lowered and a bandwidth is broadened. A starting frequency $f_L$ and an upper limit frequency $f_H$ with N, the entire height H of the radiating member 110, the entire length S of a single radiating member, a ratio HR of the antenna height to a length $\lambda_0/4$ of the starting frequency $f_L$ (HR=Height ratio), and a bandwidth ratio are summarized in Table 2.

In Table 2, for N=1, 2 and 3, the height ratio HR (a ratio of the antenna height to a length $\lambda_0/4$ of the starting frequency $f_L$) is between 50% and 60%, and the bandwidth ratios are respectively 1.8:1, 2.2:1 and 2.4:1. That is, the bandwidth is progressively increased as N increases. This characteristic of the multiple meander strip monopole antenna is in contrast to a characteristic of a wire monopole antenna, in which a bandwidth is reduced as the antenna is miniaturized by increasing the number of bending.

TABLE 2

| Comparison of characteristic for N | | | | | | |
|---|---|---|---|---|---|---|
| | $f_L$ (GHz) | $f_H$ (GHz) | H (mm) | S (mm) | HR (%) | Bandwidth Ratio |
| N = 1 | 4.7 | 8.4 | 9.5 | 18.5 | 59.5 | 1.8:1 |
| N = 2 | 3.48 | 7.82 | 11 | 24.5 | 51.1 | 2.2:1 |
| N = 3 | 3.15 | 7.6 | 12.5 | 30.5 | 52.5 | 2.4:1 |

Based on the basic characteristic of this multiple meander strip antenna, an antenna of N=5, which is suitable for the ultra-wide band (UWB) communication, was designed and constructed, and its characteristics were analyzed. A commercial EM simulator MicroWave Studio (produced by CST) was used to calculate the antenna characteristic, and HP 8510C Vector Network Analyzer was used to measure the return loss of the antenna.

Figure 5A:
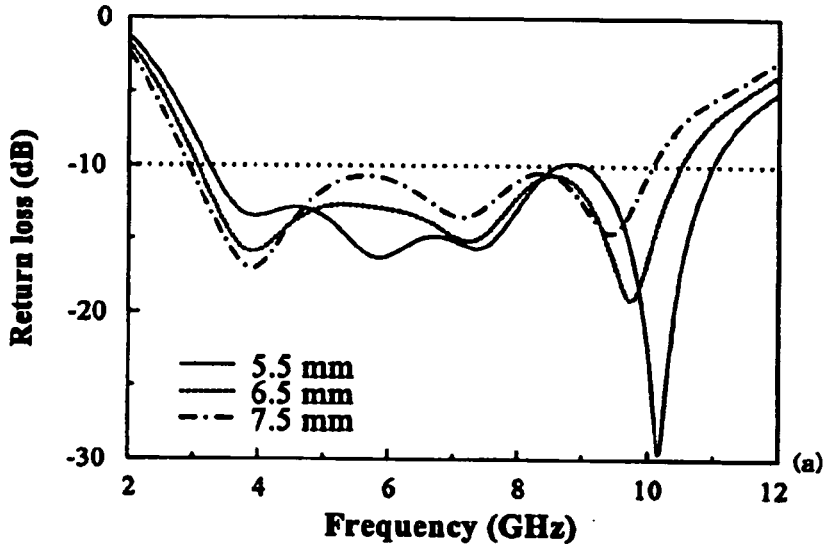
FIGS. 5*a*, 5*b* and 5*c* are graphs showing the variation of return loss according to the antenna design parameters $h_1$, a, and $h_2$ respectively in N=5.
Figure 5B:
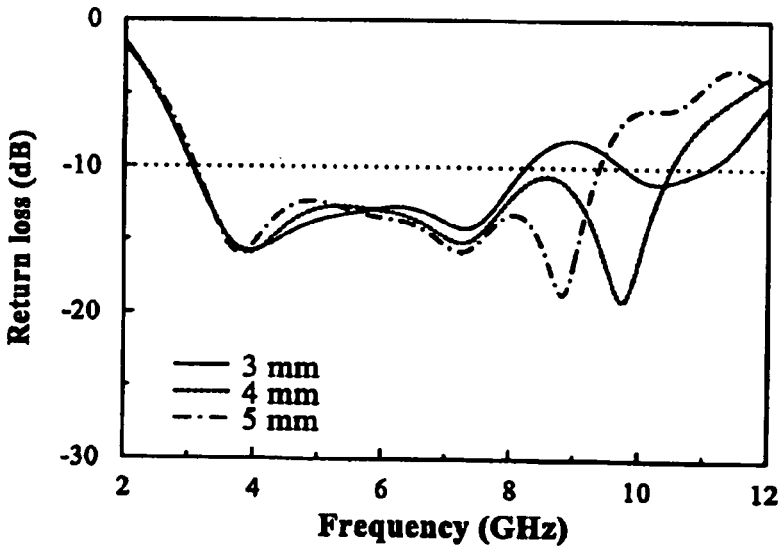
Figure 5C:
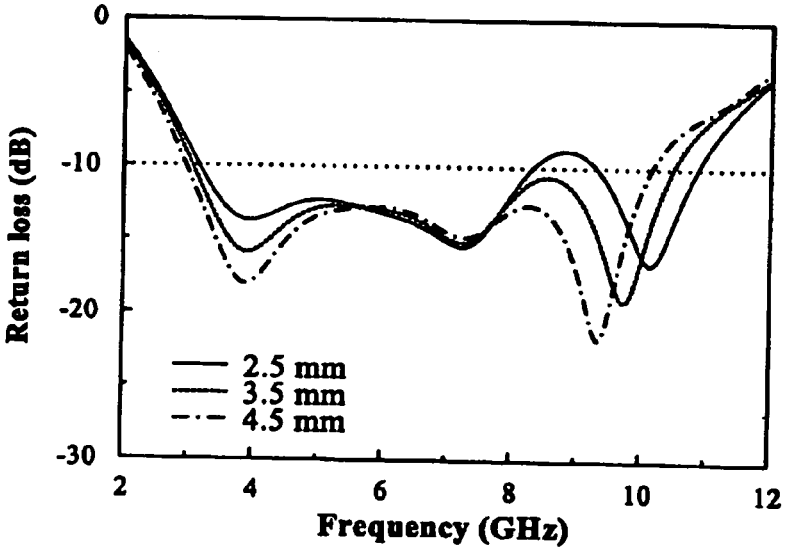

The important design parameters for the proposed antenna of N=1 are shown in FIGS. 2*b* to 3. Among the various design parameters on the antenna shown in FIG. 2*b*, $h_n$(n=1~6) determining the overall height of the antenna, and the length a of the horizontal strip act as major design parameters determining the matching characteristic of the antenna. In order to examine an effect of each design parameter on a return loss, the variation of characteristics according to the major design parameters was shown in FIGS. 5*a*, 5*b*, and Sc. FIGS. 5*a*, 5*b* and 5*c* are graphs showing the variation of return loss respectively according to the antenna design parameters $h_1$, a, and $h_2$.

In FIG. 5*a*, it has been found that the matching frequency band varies upwards and downwards with the length of $h_1$. It is also found that generally the change of the return loss is small and the bandwidth is maintained constant. In FIG. 5*b*, it is shown that there are little variations of a starting frequency and a return loss at a frequency under 8 GHz according to the variation of a, and a variation at a higher frequency range is relatively large. FIG. 5*c* shows that the variation of the height $h_2$ changes the matching frequency band, similar to the case of $h_1$, and thus the matching characteristic can be improved by controlling $h_2$. Other heights $h_3$ to $h_6$ also have effects similar to $h_1$, and overall matching characteristic is degraded as W is increased since a space between the radiating members is broadened. From the results of FIGS. 5*a*, 5*b*, and 5*c*, it has been found out that a major parameter determining the matching frequency band is $h_n$ indicating the overall height of the antenna. In addition, the effect of a (the horizontal strip length) on the resonance length of the antenna is relatively small, as compared with $h_n$. Furthermore, the matching characteristic at a high frequency range can be improved by controlling the length a and the heights $h_2$ to $h_6$.

The results of FIGS. 5*a*, 5*b* and 5*c* are applied, in the same way, to the meander strip monopole antenna structure having different values of N. The antenna design parameters having the above-described characteristics were obtained by an optimization process and are shown in Table 3. The results of FIGS. 5*a*, 5*b*, and 5*c* are obtained using the same value of the design parameters as shown in Table 3, except for the parameters to be varied.

TABLE 3

| The design parameter values of the antenna (Unit: mm) | | |
|---|---|---|
| Design parameter | | Design value |
| W | — | 14 |
| a | — | 4 |
| b | — | 4.5 |
| H | — | 14 |
| $h_n$ | $h_1$ | 6.5 |
| | $h_2$ | 3.5 |
| | $h_3$ | 1 |
| | $h_4$ | 1 |
| | $h_5$ | 1 |
| | $h_6$ | 1 |
| R | — | 50 |

As shown from Tables 2 and 3, an effective resonant length of the antenna of the invention is relatively short, as compared with the overall strip length. That is because an electric length of the antenna becomes shortened by a coupling between the strips. The effective resonance length becomes more shortened as N is increased or a gap between the horizontal strips is reduced by the reduction of the heights, $h_2$ to $h_6$. RT Duroid 5880 substrate having a thickness of 1.6 mm and a relative dielectric constant $\epsilon_r$ of 2.2 was used for the grounding conductor plate 140 of the antenna. The radiating member is constructed using a copper plate having a thickness of 0.1 mm.

Figure 6:
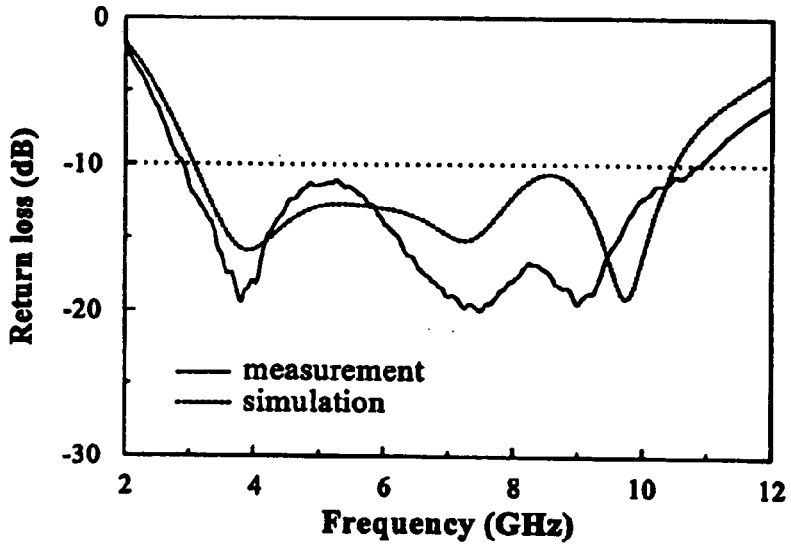
FIG. 6 is a graph showing a return loss of an antenna manufactured using the design parameters of Table 3.

The return loss of the antenna made using the design parameters of Table 3 is shown in FIG. 6. The general tendency of the measured return loss of the constructed antenna is well matched with the calculated result. In the calculated return loss, however, the resonance generated at around 10 GHz is shifted toward the lower frequency range by about 1 GHz, and the measured bandwidth is a little broader than that of the calculated result. This is considered as the results of manufacturing error, which is caused because the gaps ($h_3$ to $h_6$) between horizontal strips of the meander strip section 214 of the antenna of the invention are as narrow as 1 mm. The measured bandwidth of the antenna is from the starting frequency, 2.9 GHz, to the upper limit frequency, 10.8 GHz. As understood from Table 3, a volume occupied by the antenna, except for the grounding conductor plate, is 14(W)×14(W)×14(H) $mm^1$. The height of the antenna is about 56% of 25 mm, which is $\lambda_0/4$ length of the starting frequency 3 GHz of the calculated return loss. It can be understood that the antenna of the invention not only has a characteristic of a broadband including a frequency band from 3.1 GHz to 10.6 GHz suitable for the UWB communication, which has recently attracted attentions, but also has a smaller size, as compared with the conventional broadband antennas. Consequently, the antenna according to the invention meets well the requirements for a broadband/small antenna needed for the UWB communication.

In the antenna 200 shown in FIG. 2*a*, a power is fed at the center of the cruciform strip positioned on the dielectric base plate 130 through a coaxial cable. Thus, a feeder signal is applied, in the same phase, to each radiating member 210*a* to 210*d*, and currents flowing on the horizontal strips between the meander strips 214 facing each other have opposite phases by 180°. Due to the 180° phase difference, the signals radiated from four meander strip sections 214 are cancelled out on the axial line of θ=0°, and the radiation gain increases as θ increases. Therefore, the multiple meander strip monopole antenna of the invention has a conical beam radiation pattern.

Figure 7A:
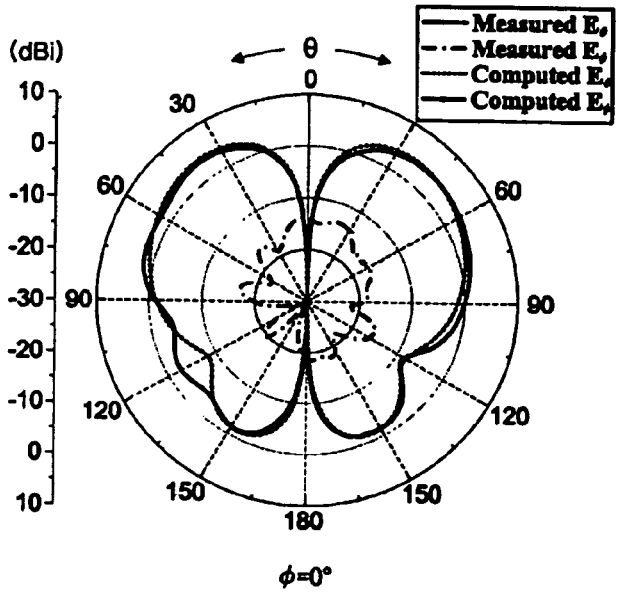
FIGS. 7*a* and 7*b* show a comparison of measured E-plane radiation pattern of the antenna 200 with a calculated result for the cross-sections of Φ=0°, Φ=45° at 4 GHz.
Figure 7B:
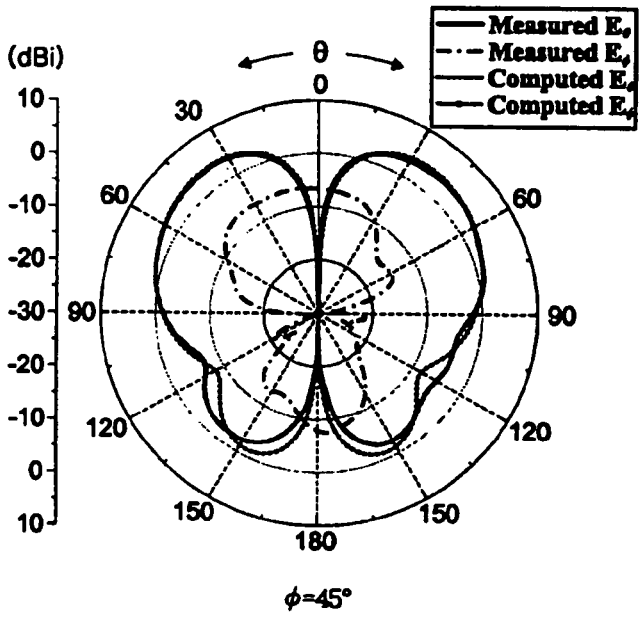
Figure 8A:
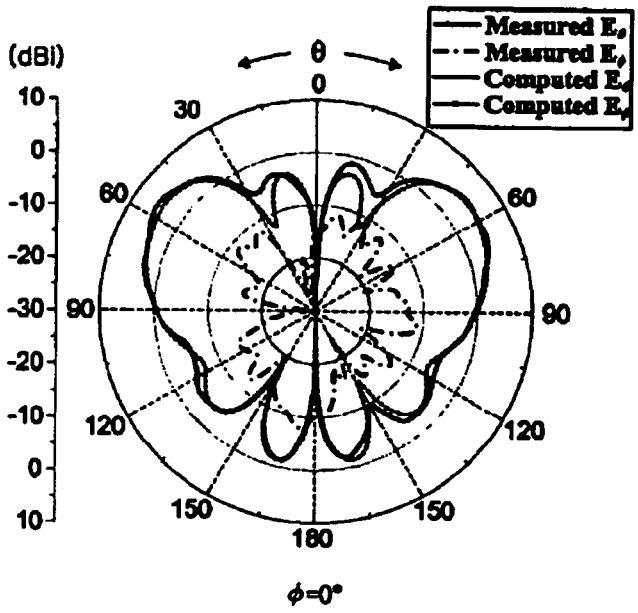
FIGS. 8*a* and 8*b* show a comparison of measured E-plane radiation patterns of the antenna with a calculated result for the cross-sections of Φ=0°, Φ=45° at 7 GHz.
Figure 8B:
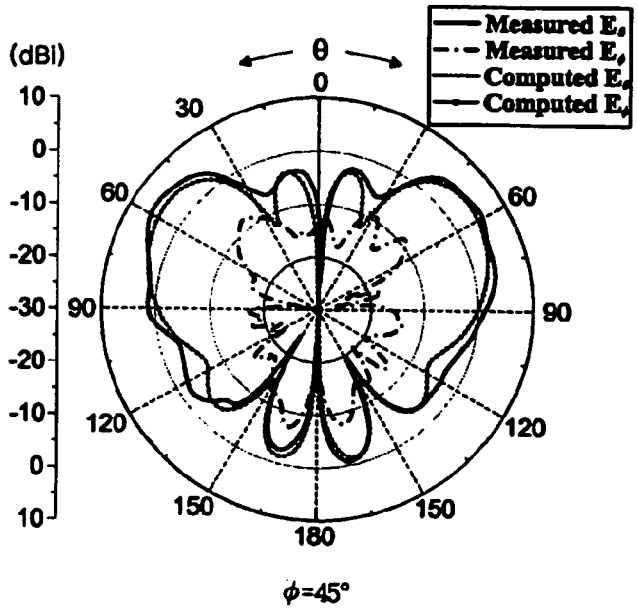
Figure 9A:
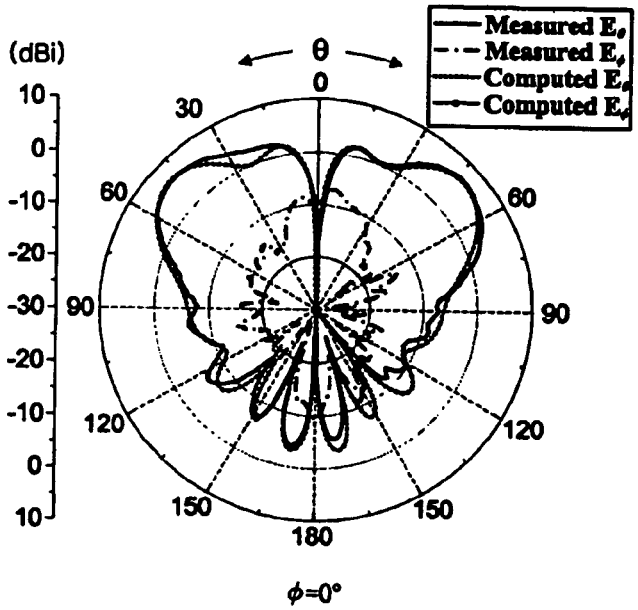
FIGS. 9*a* and 9*b* show a comparison of measured E-plane radiation patterns of the antenna with a calculated result for the cross-sections of Φ=0°, Φ=45° at 10 GHz.
Figure 9B:
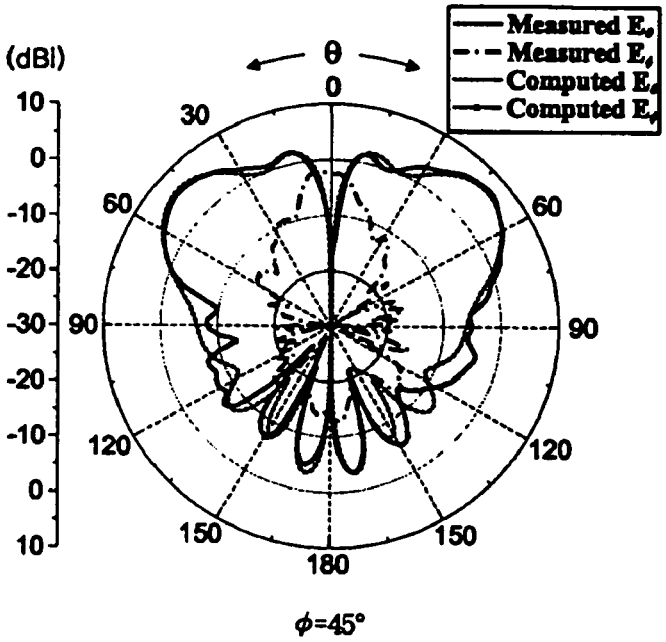

FIGS. 7*a* and 7*b* show a comparison of measured E-plane radiation pattern of the antenna 200 with a calculated result for the cross-sections of Φ=0°, Φ=45° at 4 GHz. Similarly, FIGS. 8*a* and 8*b* show a comparison of measured E-plane radiation patterns of the antenna with a calculated result for the cross-sections of Φ=0°, Φ=45° at 7 GHz. FIGS. 9*a* and 9*b* show a comparison of measured E-plane radiation patterns of the antenna with a calculated result for the cross-sections of Φ=0°, Φ=45° at 10 GHz. As understood from FIGS. 7, 8, and 9, generally, the measured radiation gains and patterns of the antenna are matched relatively well with the calculated results. A co-polarized wave is well matched with the calculated result, but a measured cross-polarized wave is relatively large due to an error of manufacturing and measurement, while the calculated cross-polarized wave is negligible as less than −40 dBi. Similar to the folded multi-strip monopole antenna 100 of N=1 as shown in FIG. 1*a*, the radiation pattern of the cross-sections of Φ=0° and Φ=45° has approximately the same gain, and the difference between a maximum and minimum of the radiation gain of the calculated H-plane radiation pattern is less than 0.1 dBi. Therefore, it has been found out that the multiple meander strip monopole antenna of the invention has an excellent omni-directional radiation characteristic.

As described above, the present invention has proposed a folded multi-strip monopole antenna 100 and a multiple meander multi-strip monopole antenna 200. The folded multi-strip monopole antenna 100 is constructed by bending a vertical strip into a '⊐'-shape, so that a miniaturization and a broadband characteristic are obtained. Based on the structure of the folded multi-strip monopole antenna 100, the multiple meander multi-strip monopole antenna 200 is constructed by repeatedly connecting a '⊓'-shaped strip thereon, so that a broader bandwidth can be obtained. It was found that the bandwidth is increased as the number of meandering turns N is increased, and the measured bandwidth ratio 3.7:1 can be obtained in the proposed antenna of N=5. The antenna of the invention has a bandwidth from 2.9 GHz to 10.85 GHz, which includes the available frequency band from 3.1 GHz to 10.6 GHz suitable for the UWB communication, which recently has attracted an attention. The size of the radiating member, 14(W)×14(W)×14(H) $mm^1$, meets well the requirements of a broadband/small antenna, which is needed in the modern wireless communication. Moreover, an excellent omni-directional radiation characteristic having the same gain in all directions can be applied to an antenna for access point of the UWB wireless LAN or the wireless home network.

While the present invention has been described with reference to several preferred embodiments, the description is illustrative of the invention and is not to be construed as limiting the invention. Various modifications and variations may occur to those skilled in the art without departing from the spirit and scope of the invention as defined by the appended claims.

What is claimed is:

1. A multiple meander strip monopole antenna comprising:

a dielectric base plate;

a radial cross-strip, having a plurality of branches of equal length which extend into a radial direction with equiangular intervals therebetween, disposed on the upper surface of the dielectric base; and a multiple radiator including the same number of radiating members as that of the branches of the radial cross-strip, each radiating member being composed of a vertical strip section formed of a flat conductor strip and a meander strip section connected integrally to the upper end of the vertical strip section, the meander strip section constituting a '⊐'-shaped conductor strip, wherein each radiating member is connected to the end portion of each corresponding branch of the radial cross-strip and stands substantially perpendicular to the base plate, by the vertical strip section.

2. An antenna according to claim 1, wherein the meander strip section further includes at least one conductor strip having a '⊓' shape which is connected, in a meander fashion, to the end of the '⊐'-shaped conductor strip, to form a multi-stepped strip section.

3. An antenna according to claim 1, wherein each radiating member of the multiple radiator has a same structure, and is disposed symmetrically about the center of the radial cross-strip on the upper surface of the base plate, wherein, when a feeding point is positioned at the center of the radial cross-strip, current components flowing that portion of the meander strip section parallel to the base plate are cancelled out so that a signal radiated from the multiple radiator is cancelled out in the axial direction of θ=0° and a radiation gain increases as θ increases, thereby providing a conical beam radiation pattern.

4. An antenna according to claim 1, wherein the vertical strip section has a tapered structure, in which its width is progressively widened upwardly for an impedance matching.

5. An antenna according to claim 1, wherein the total length of the vertical strip section and the meander strip section is $\lambda_0/4$, where $\lambda_0$ is wavelength corresponding to a desired matching frequency.

6. An antenna according to claim 1, wherein a ratio of the height of the multiple radiator to the $\lambda_0/4$ length of a starting frequency is less than 60%, where $\lambda_0$ is wavelength corresponding to a desired matching frequency.

7. An antenna according to claim 1, further comprising a grounding conductor plate coupled to the under face of the base plate.

8. An antenna according to claim 7, wherein the grounding conductor plate has a circular shape.

9. An antenna according to claim 1, wherein the radial cross-strip comprises X branch-strips each having a same line-width and length and being disposed in equiangular intervals of 360°/X.

* * * * *